US007600505B2

(12) United States Patent
Pattullo

(10) Patent No.: US 7,600,505 B2
(45) Date of Patent: Oct. 13, 2009

(54) FUEL SYSTEM PURGE AND STARTER SYSTEM

(75) Inventor: George M. Pattullo, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 368 days.

(21) Appl. No.: 11/092,532

(22) Filed: Mar. 29, 2005

(65) Prior Publication Data

US 2006/0219225 A1 Oct. 5, 2006

(51) Int. Cl.
*F02M 37/20* (2006.01)

(52) U.S. Cl. ..... 123/516; 123/185.6

(58) Field of Classification Search ..... 123/516, 123/179.16, 179.12, 179.14, 185.3; 261/35
See application file for complete search history.

(56) References Cited

U.S. PATENT DOCUMENTS 4,291,654 A 9/1981 Obermayer
4,480,605 A 11/1984 Bloemers
4,803,963 A 2/1989 Kleinhans
5,537,966 A 7/1996 Ohnishi
5,560,345 A 10/1996 Geyer et al.
5,715,783 A 2/1998 Osakabe et al.
6,000,369 A 12/1999 Koizumi
6,394,424 B2 5/2002 Pattullo et al.
6,425,573 B1 7/2002 Suzuki
6,644,631 B2 11/2003 Suzuki
6,755,170 B2 6/2004 Morishige et al.

FOREIGN PATENT DOCUMENTS

EP 0 623 743 A 11/1994
EP 1 116 873 A2 7/2001

*Primary Examiner*—Stephen K Cronin
*Assistant Examiner*—J. Page Hufty
(74) *Attorney, Agent, or Firm*—Reising Ethington P.C.

(57) ABSTRACT

A recoil starter for an internal combustion engine has a housing with a pulley carried at least in part for rotation therein. The pulley is arranged in operable communication with a crankshaft of the engine. A pull cord is wound about the pulley with one end of the cord being arranged to be pulled by a user to rotate the pulley. An actuator is carried for rotation in response to rotation of the pulley. A pump is arranged for actuation in response to rotation of the actuator to provide fresh liquid fuel to a carburetor and remove fuel vapor and stale fuel from the carburetor and deliver it to a fuel tank prior to starting the engine.

19 Claims, 2 Drawing Sheets

FUEL SYSTEM PURGE AND STARTER SYSTEM

FIELD OF THE INVENTION

The present invention relates generally to fuel systems for small internal combustion engines, and more particularly to a system for purging the fuel system and starting such engines.

BACKGROUND OF THE INVENTION

Small internal combustion engines often have a manually operated purge pump in fluid communication with a carburetor to allow fuel vapor and stale liquid fuel to be purged from the carburetor. The pump is generally attached directly to the carburetor, or located remotely from the carburetor. The pump is actuated by manually depressing a flexible bulb, thereby causing liquid fuel and fuel vapor within the bulb to be directed through a downstream fuel line to a fuel tank. Upon releasing the bulb, it expands to its non-deformed state, thereby drawing liquid fuel and any fuel vapor into the bulb through an upstream fuel line. Usually the bulb must be manually depressed and released 5 to 25 times to ensure that the fuel vapor is purged from the upstream fuel line. With the fuel vapor purged from the carburetor, liquid fuel generally free from fuel vapor is delivered to the engine to facilitate starting and initial operation of the engine.

Sometimes users mistake the purge pump for a priming pump and limit the number of manual actuations of the pump out of fear of "flooding" the engine. As a result, the carburetor may not be fully purged of fuel vapor prior to initiating a starting procedure for the engine, thus, making starting the engine difficult. In addition to not actuating the pump enough times, a user not familiar with the apparatus may not see the pump, or may otherwise fail to actuate the pump. As a result, it may be difficult to start and initially maintain operation of the engine.

SUMMARY OF THE INVENTION

A recoil starter for an internal combustion engine has a pulley with a pull cord in operable communication with a crankshaft of the engine to control initial rotation of the crankshaft and starting of the engine in response to pulling the pull cord. When pulled, the pull cord rotates the pulley in an unwinding direction of the cord prior to causing the crankshaft to rotate. An actuator is rotated in response to rotation of the pulley, and a pump is driven by the actuator to pump liquid fuel and fuel vapor away from a carburetor and toward a fuel tank to prime the fuel system and facilitate starting the engine.

A method of constructing an engine recoil starter and fuel system for an internal combustion engine is also provided. The recoil starter system has a housing sized for at least partial receipt of a recoil pulley arranged for operable communication with a crankshaft of the engine and a pull cord wound about the recoil pulley. The method of construction comprises, providing a pump and an actuator. Arranging the pump for operable communication with a fuel passage upstream of the pump and a fuel passage downstream of the pump. And, arranging the actuator for movement in response to rotation of the recoil pulley so that the actuator engages the pump during at least a portion of the rotation of the recoil pulley prior to the crankshaft being caused to rotate to at least partially prime the fuel system upon pulling the pull cord and prior to rotating the crankshaft.

The recoil starter and pump facilitates starting the internal combustion engine by automatically inhibiting fuel vapor and stale liquid fuel from reaching a carburetor air-fuel mixing passage of the engine as the user pulls the pull cord. The recoil starter and pump preferably purges the stale liquid fuel and fuel vapor from the carburetor prior to the crankshaft of the engine being rotated. As such, as the crankshaft is rotated, the carburetor receives fresh liquid fuel that is generally free from fuel vapor to facilitate starting the engine.

Some of the objects, features and advantages of the invention include providing a recoil starter system that automatically purges fuel vapor and stale liquid fuel from a carburetor while pulling a cord of the recoil starter system, reduces the number of steps to start an engine, improves the ease in starting an engine, eliminates the need to manually actuate a purge pump to purge the carburetor prior to starting the engine, automatically actuates a purge pump a sufficient number of times, purges a carburetor of vapor and stale fuel prior to the crankshaft being rotated, is relatively simple in design and manufacture, is economical in manufacture, and has a long useful life in-service.

BRIEF DESCRIPTION OF THE DRAWINGS

These and other objects, features and advantages of this invention will become readily apparent in view of the following detailed description of the presently preferred embodiments and best mode, appended claims and accompanying drawings, in which:

DETAILED DESCRIPTION OF THE PRESENTLY PREFERRED EMBODIMENTS

Figure 1:
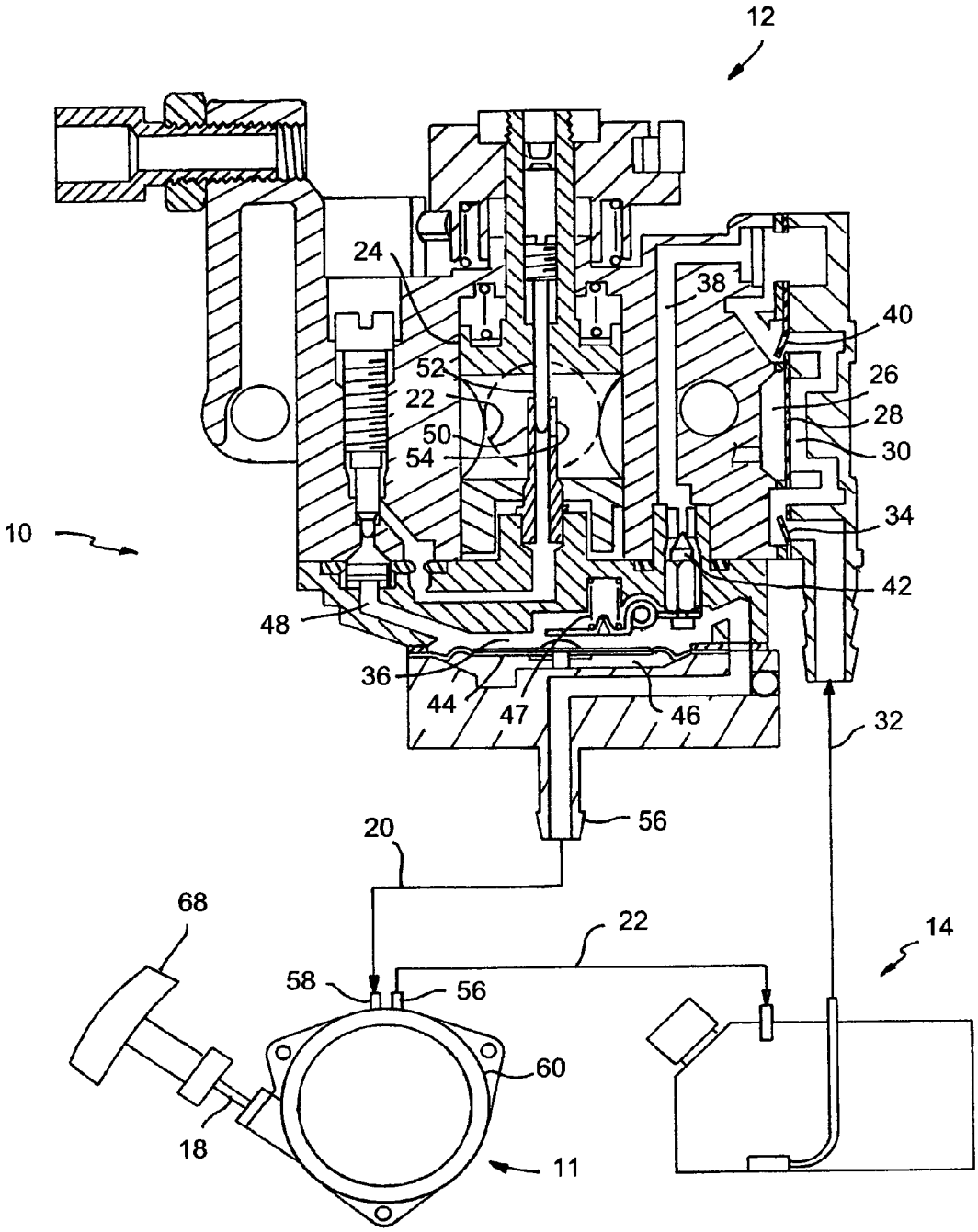
FIG. 1 is a schematic view of a carburetor shown in cross-section that is communicated with a fuel tank and a recoil starter and pump constructed according to one presently preferred embodiment of the invention.

Referring in more detail to the drawings, FIG. 1 illustrates an engine recoil starter and fuel system 10 constructed according to one presently preferred embodiment of the invention, and including a recoil starter 11 in fluid communication with a carburetor 12 and a fuel tank 14. The system 10 has a pump 16 (FIGS. 3 and 4) that is actuated in response to movement of a pull cord 18 of the recoil starter 11, such as when the cord 18 is pulled to start an engine (not shown). During actuation of the pump 16, fuel vapor and stale liquid fuel are purged from the carburetor 12 via one fuel passage 20 upstream of the pump 16 and preferably directed away from the pump 16 and to the fuel tank 14 via another fuel passage 22 downstream of the pump 16. Accordingly, the system 10 ensures that the carburetor 12 receives fresh, liquid fuel that preferably is essentially free of fuel vapor by automatically purging the upstream fuel passage 20 while the pull cord 18 is being pulled, thereby providing a user with a quick and easy mechanism by which to start the engine. The pump 16 can be incorporated in a variety of recoil starter types, such as any variety of the so called "easy pull" starters, such as that disclosed in U.S. Pat. No. 5,537,966 to Ohnishi by way of example and without limitation which is incorporated herein by reference.

The carburetor 12 is represented here as a rotary valve type carburetor, though it could be any diaphragm type carburetor, such as those having a butterfly throttle valve (not shown), for example. As is known, the carburetor 12 has an intake or air-fuel mixing passage 22 with a rotary throttle valve 24 received at least in part in the mixing passage 22. The carburetor 12 has a pulsating pressure chamber 26 communicating with a crankcase of the engine to receive pulsating pressure therefrom. A pump diaphragm 28 separates the pressure chamber 26 from a pump chamber 30 that communicates with the fuel tank 14 via a fuel passage 32. As the pump diaphragm 28 is flexed or reciprocated under the pulsating pressure from the crankcase a check valve 34 allows liquid fuel to flow to the pump chamber 30 and prevents the reverse flow of liquid fuel from the pump chamber 30 back toward the fuel tank 14.

A fuel passage 38 communicates the pump chamber 30 with a fuel metering chamber 36 downstream of the pump chamber 30. The fuel passage 38 preferably has a one way check valve 40 between the pump chamber 30 and the metering chamber 36 to facilitate regulating the flow of liquid fuel from the pump chamber 30 to the metering chamber 36. The check valve 40 closes when the pump diaphragm 28 draws fuel from the fuel tank 14, and opens when the pump diaphragm 28 transfers fuel to the metering chamber 36, as is known. To further regulate the flow of liquid fuel through the passage 38 and into the metering chamber 36, preferably a pivotally supported fuel inlet valve 42 moveable between open and closed positions is interposed between the pump chamber 30 and the metering chamber 36, and preferably between the check valve 40 and the metering chamber 36.

The metering chamber 36 is defined in part by one side of a diaphragm 44, and an atmospheric chamber 46 is defined on the opposite side of the diaphragm 44. As is known, the diaphragm 44 flexes or moves in response to a pressure differential across it to control movement of the fuel inlet valve 42 between its open and closed positions. When the pressure in the metering chamber 36 is less than the pressure in the atmospheric chamber 46, the diaphragm 44 moves or flexes upwardly and moves the fuel inlet valve 42 to its open position. When the pressure in the metering chamber 36 is equal to or less than the pressure in the atmospheric chamber 46, the fuel regulator valve 42 remains in its closed position, and may be biased to its closed position by a spring 47.

The metering chamber 36 is in fluid communication with the mixing passage 22 via a fuel passage 48, defined in part by a fuel nozzle 50. The fuel nozzle 50 has an opening 54 through which fuel is dispensed into the air-fuel mixing passage 22 at a desired flow rate, depending on the position of a valve needle 52 within the fuel nozzle 50 and the relative pressures between the air-fuel mixing passage 22 and the metering chamber 36, as is known.

The metering chamber 36 is preferably in direct fluid communication with the pump 16 via the fuel passage 20 upstream of the pump 16, wherein the pump 16 can be carried by the carburetor 12, or as shown here, by way of example and without limitation, being carried by the recoil starter 11. The fuel passage 20 can span a short or relatively long distance, as necessary, depending on the proximity of the pump 16 and/or recoil starter 11 to the carburetor 12. To facilitate routing the fuel passage 20, preferably a flexible fuel line is used, with a liquid tight connection between an outlet port 56 extending from the carburetor 12 and an inlet port 58 of the pump 16, shown here as extending from a housing 60 of the recoil starter 11.

Figure 2:
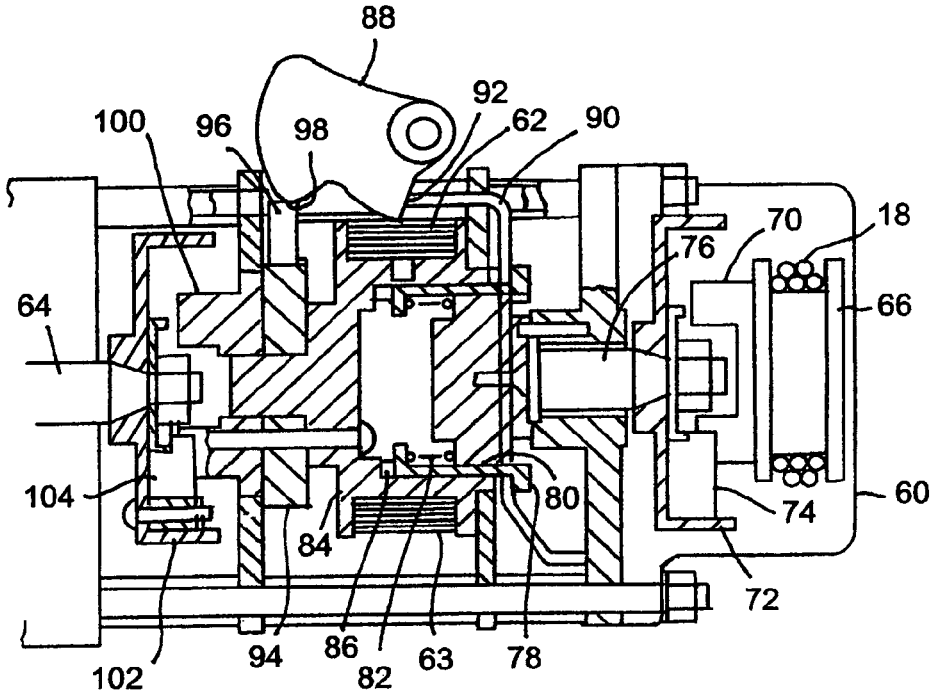
FIG. 2 is a partial cross-sectional view of the recoil starter of FIG. 1.

As shown in FIG. 2, and as disclosed in U.S. Pat. No. 5,537,966 to Ohnishi, incorporated herein by reference in its entirety by way of example and without limitation, the recoil starter 11 is represented as an "easy pull" type starter assembly wherein energy is stored in at least one spring, and as shown here a pair of springs 62, 63 that operably couple the pulley 66 to a crankshaft 64 to facilitate turning over the crankshaft 64 of the engine. The housing 60 is sized for receipt of a recoil pulley 66 which has the starter rope or cord 18 wrapped about its outer periphery, with one end of the cord being attached to the pulley 66, and another end of the cord 18 having a handle 68 (FIG. 1) attached thereto. The pulley 66 has a drive member or block 70 extending laterally from a side of the pulley 66 for operable engagement with a drive wheel 72 via lugs or dogs 74 pivotally attached to the drive wheel 72. As the pull cord is unwrapped from the pulley the pulley is rotated in a first or unwinding direction P (FIGS. 3 and 4) and the dogs 74 are engaged by the block 70, thereby causing the drive wheel 72 to rotate conjointly with the recoil pulley 66. However, as the recoil pulley 66 rotates in a second or winding direction under the bias of a recoil spring to rewind the cord 18, the dogs 74 allow the drive wheel 72 to remain generally stationary.

The drive wheel 72 is connected to a drive shaft 76 that is in operable communication with a first drum 78 via a planetary reduction member, represented here by way of example, as a planetary gear set 80. The planetary gear set 80 causes the first drum 78 to rotate at a slower angular velocity and in an opposite direction to the drive wheel 72. The first drum 78 is biased axially by a spring 82 in one direction for operable communication with a second drum 84. The first and second drums 78, 84 have an axially engaging and disengaging clutch 86 interposed between them, so that the second drum 84 rotates conjointly with the first drum 78 when the clutch 86 is in its engaged position. Otherwise, when the clutch 86 is disengaged, the second drum 84 is free to rotate relative to the first drum 78.

The clutch 86 is arranged to be manually disengaged via a release mechanism 88. When the release mechanism 88 is actuated, a spring 90 is urged axially by a surface 92 of the mechanism 88, thereby causing the first drum 78 to move axially away from the second drum 84. As such, the clutch 86 is disengaged, and the second drum 84 is substantially free to rotate relative to the first drum 78. When the release mechanism 88 is released the first drum 78 moves axially back toward the second drum 84 under the bias of the spring 82, thereby returning the clutch 86 to its engaged position.

The second drum 84 is operably attached to the pair of springs 62, 63 so that upon rotation of the second drum 84 in response to rotation of the first drum 78, the springs 62, 63 are wound to store energy. To prevent the stored energy from releasing inadvertently, the second drum 84 has a ratchet wheel 94 attached thereto for locking and unlocking communication with a pivotal locking mechanism, such as a pawl 96. The locking mechanism 96 moves between a locked position and an unlocked position in response to depressing and releasing the release mechanism 88, respectively. When pushing the release mechanism 88, a surface 98 of the mechanism 88 forcefully engages the locking mechanism 96, thereby causing it to pivot out of locking engagement with the ratchet wheel 94. As a result, the second drum 84 is free to rotate under the bias of the springs 62, 63 and the stored energy within the springs 62, 63 continues to increase while the drum 84 rotates and is maintained until the release mechanism 88 is depressed.

Also attached for conjoint rotation with the second drum 84 is a drive member or block 100. The block 100 extends laterally from a side of the second drum 84 for operable engagement with a starter wheel 102 via lugs or dogs 104, substantially the same as described above for the communication between the pulley 66 and the drive wheel 72. As such, the rotation of the block 100 causes conjoint rotation of the starter wheel 102 via the dogs 104. Increased rotational velocity of the starter wheel 102 relative to the block 100 is permitted as a result of the dogs 104 acting as a one-way clutch. The starter wheel 102 is preferably fixed to the crankshaft 64 of the engine so that the crankshaft 64 rotates conjointly with the starter wheel 102.

Figure 3:
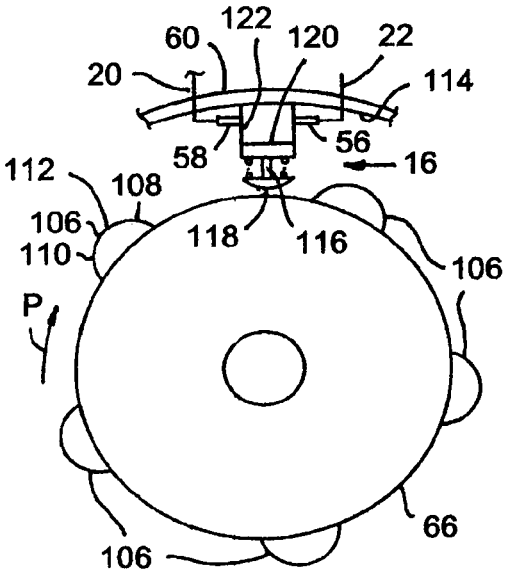
FIG. 3 is a schematic view of the recoil starter of FIG. 1 showing a recoil pulley constructed according to one embodiment of the invention and a pump with a plunger in an uncompressed position.
Figure 4:
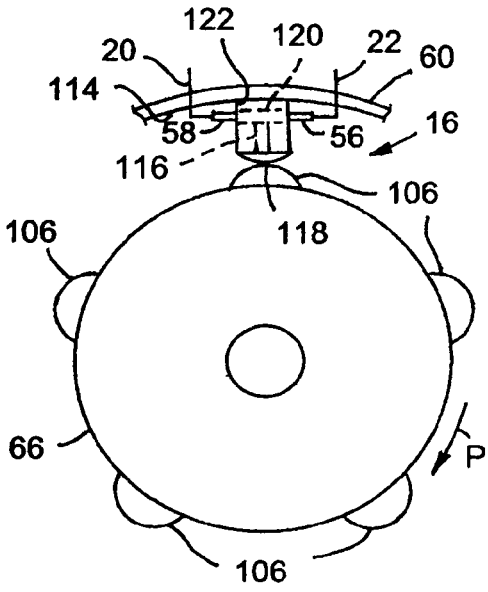
FIG. 4 is a view similar to FIG. 3 showing the plunger in a compressed position.

As shown in FIGS. 3 and 4, an actuator 106 preferably is carried for movement in response to rotation of the pulley 66, and is shown here, by way of example and without limitation, as being carried in the housing 60 for conjoint movement with the pulley 66 in the unwinding and winding directions. The actuator is represented here, by way of example and without limitations, as a plurality of cam lobes 106. The cam lobes 106 are shown here as being circumferentially spaced equidistant from one another and extending radially outwardly from the periphery of the pulley 66 a sufficient distance to actuate the pump 16. The cam lobes 106 can be formed as one piece with the pulley 66, or attached thereto via a fastener, or a weld joint, by way of example and without limitation. It should also be recognized that the cam lobes 106 can be attached to a side of the pulley 66, or otherwise carried in the housing 60 for rotation in response to rotation of the pulley 66. Each cam lobe 106 preferably has outwardly extending leading and trailing surfaces 108, 110, respectively, that converge at a generally arcuate apex 112. The leading surfaces 108 facilitate a smooth engagement with the pump 16, while the trailing surfaces 110 facilitate a smooth disengagement from the pump 16, thereby minimizing the impact loads, wear and noise resulting from the engagement of the cam lobes 106 with the pump 16.

The pump 16 preferably is carried at least in part in the housing 60, and is shown here as being attached to an inner surface 114 of the housing 60. The pump 16, by way of example and without limitation, can be a diaphragm pump, a bulb-type pump, or a positive displacement piston-type pump, as represented here. The pump 16 has a plunger 116 arranged for actuation from an uncompressed, extended position to a compressed, retracted position in response to rotation of the cam lobes 106, and as shown here, when engaged by cam lobes 106. The plunger 116 preferably has a durable, wear resistant, low friction head 118 at one end, to facilitate smooth actuation upon engagement with the cam lobes 106, and a piston 120 at its other end. The head 118 is preferably rounded to further reduce impact forces upon engagement with and disengagement from the cam lobes 106. The piston 120 is slidably received for reciprocation in a cylinder bore 122 in the housing of the pump 16. The piston 120 may incorporate circumferential piston rings to provide a liquid tight seal about the periphery of the piston 120 as it reciprocates within the cylinder bore 122.

The pump 16 has its inlet 58 arranged for fluid communication with the fuel passage 20 upstream from the pump 16, and its outlet 56 arranged for fluid communication with the fuel passage 22 downstream from the pump 16. Preferably, the inlet 58 incorporates a one-way valve allowing the ingress of liquid fuel and fuel vapor into the cylinder bore 122, while preventing the egress of liquid fuel and fuel vapor therethrough. Similarly, the outlet 56 preferably incorporates a one-way valve allowing the egress of liquid fuel and fuel vapor from the cylinder bore 122, while preventing the ingress of liquid fuel and fuel vapor therethrough.

To start the engine, whether it is cold or already warmed from use, the cord 18 is pulled to rotate the pulley 66 in the unwinding direction P against the bias imparted by the recoil spring. As the pulley 66 rotates in the unwinding direction, the cam lobes 106 rotate conjointly with the pulley 66 and engage the plunger head 118 of the pump 16 to actuate the piston 120 and hence the pump 16 prior to the crankshaft 64 being caused to rotate. Each successive actuation of the pump 16 in response to engagement with and disengagement from a separate cam lobe 106 causes the pump 16 to alternately discharge liquid fuel and fuel vapor from the cylinder bore 122 to the fuel tank 14, while also taking in liquid fuel and fuel vapor preferably directly from the metering chamber 36 of the carburetor 12. As such, the carburetor 12 is automatically purged of any stale liquid fuel and fuel vapor as the pull cord 18 is pulled, and preferably prior to the crankshaft 64 being rotated. The cam lobes 106 also actuate the pump 16 while the pulley rotates in the winding direction under the bias of the recoil spring. Regardless of the number of excess purging actuations of the pump 16, the starting operation of the engine is not adversely affected, and the engine does not become "flooded" with liquid fuel since the pump preferably does not cause liquid fuel to be discharged into the carburetor fuel and air mixing passage that leads to the engine.

As the pulley 66 is rotated, energy is increasingly stored in the pair of springs 62, 63. The energy continues to be stored in the springs 62, 63 until the release mechanism 88 is depressed. The pull cord 18 may be pulled as many times as necessary prior to depressing the release mechanism 88. As such, the carburetor 12 is automatically purged of fuel vapor and stale liquid fuel prior to the crankshaft 64 being rotated and the engine being turned over. Accordingly, when the release mechanism 88 is depressed, and the crankshaft 64 is caused to rotate, the carburetor 12 is purged of fuel vapor and stale fuel, and the energy released by the springs 62, 63 rotates the crankshaft 64 to start the engine.

The automatic purging pump 16 eliminates the need for a user to search for and manually operate a purge pump, and additionally eliminates any user concern over "flooding" the engine. The number of actuations of the pump 16 per pull of the cord 18 may be altered, as desired, such as by altering the number of actuators or cam lobes 106 arranged for engagement with the pump 16. Preferably, automatic purging is complete upon one pull of the cord 18 or less, and also before the crankshaft 64 is rotated.

The embodiments of the starter system 10 discussed above are intended to be illustrative of some presently preferred embodiments of the invention, and are not limiting. Various modifications within the spirit and scope of the invention will be readily apparent to those skilled in the art. For example, the number of actuators or cam lobes 106 may be varied, depending on the nature of the application. In addition, the cam lobes 106 may be positioned other than as shown.

The invention claimed is:

1. A recoil starter system for an internal combustion engine, comprising:

a housing;

a pulley received in the housing;

at least one spring for storing energy to rotate a crankshaft of the engine, the pulley being rotatable in an unwinding direction and a winding direction, the pulley being in operable communication with the spring for rotating in the unwinding direction to store energy in the spring prior to the spring causing the crankshaft to rotate;

a pull cord wound about the pulley to facilitate rotating the pulley in the unwinding direction to store energy in the spring for rotation of the crankshaft to start the engine;

an actuator carried for movement in response to rotation of the recoil pulley;

a carburetor for the engine; and a pump driven by the actuator upon rotation of the pulley prior to initial rotation of the crankshaft by the spring to pump liquid fuel and fuel vapor from the carburetor into and away from the pump prior to rotation of the crankshaft by the spring.

2. The recoil starter system of claim 1 further comprising at least two springs operably coupling the pulley to the crankshaft, said springs storing energy as the pulley rotates in the unwinding direction to facilitate rotating the crankshaft.

3. The recoil starter system of claim 1 wherein the actuator has at least one cam lobe carried by the pulley.

4. The recoil starter system of claim 3 wherein a plurality of cam lobes are carried by the pulley.

5. The recoil starter system of claim 1 wherein the actuator engages the pump to pump fluid into a fuel tank and disengages the pump to take in fluid from a metering chamber of a carburetor.

6. The recoil starter of claim 1 wherein the pump is actuated multiple times by the actuator prior to the crankshaft of the engine being rotated by the spring.

7. A recoil starter system for an internal combustion engine, comprising:

a fuel tank;

a carburetor in fluid communication with the fuel tank;

a housing;

a pulley received in the housing in operable communication with at least one spring to store energy for rotating a crankshaft of the engine, the pulley being rotatable in an unwinding direction and a winding direction, the pulley rotating in the unwinding direction to store energy in the spring prior to the spring causing the crankshaft to rotate;

a pull cord wound about the pulley to facilitate rotating the pulley in the unwinding direction;

a cam lobe arranged for movement in response to rotation of the recoil pulley; and a purge pump actuatable by the cam lobe to take in liquid fuel and fuel vapor from the carburetor and to discharge liquid fuel and fuel vapor into the fuel tank prior to initial rotation of the crankshaft by the spring during an attempt to start the engine to facilitate starting the engine.

8. The recoil starter system of claim 7 wherein the carburetor has a pump chamber in fluid communication with a metering chamber with a check valve therebetween to regulate the flow of fluid from the pump chamber to the metering chamber, the purge pump being in direct fluid communication with the metering chamber to take in fluid from the metering chamber.

9. The recoil starter system of claim 8 wherein the purge pump has a plunger movable between a retracted position and an extended position, the purge pump pumping fluid into the fuel tank while moving toward the retracted position and taking in fluid from the metering chamber while moving toward the extended position.

10. The recoil starter system of claim 7 wherein the purge pump is actuated multiple times by rotation of the pulley prior to the crankshaft being caused to rotate by the spring.

11. The recoil starter system of claim 7 wherein the purge pump is actuated by the actuator as the pulley rotates in both the unwinding direction and the winding direction.

12. A method of purging a fuel system of an engine, the engine having a recoil starter with a pulley in operable communication with a spring to store energy to rotate a crankshaft and with a pull cord wound about the pulley, an actuator arranged for movement in response to rotation of the pulley, a purge pump arranged in operable communication with the actuator and in fluid communication with a fuel tank downstream from the pump and a carburetor upstream from the pump, the method comprising the steps of:

pulling the pull cord in an unwinding direction to cause movement of the pulley to store energy in the spring and conjoint movement of the actuator to actuate the purge pump prior to the crankshaft being caused to rotate by the spring, the purge pump taking in fluid from the carburetor and discharging such fluid into the fuel tank at least in part prior to rotation of the crankshaft by the spring.

13. The method of claim 12 wherein the carburetor has a pump chamber upstream from a metering chamber with a check valve therebetween, the pump being in direct fluid communication with the metering chamber to purge vapor directly from the metering chamber.

14. The recoil starter system of claim 1 which also comprises a fuel tank in fluid communication with the carburetor, and wherein the actuator comprises at least one cam lobe carried by the pulley to drive the pump in response to rotation of the pulley and the pump communicates with the fuel tank for discharge of liquid fuel vapor into the fuel tank by the pump.

15. The recoil starter system of claim 14 wherein the carburetor has a pump chamber in fluid communication with a metering chamber with a check valve therebetween to regulate the flow of fluid from the pump chamber to the metering chamber, the pump being in direct fluid communication with the metering chamber to take in fluid from the metering chamber.

16. The recoil starter system of claim 15 wherein the pump has a plunger movable between a retracted position and an extended position and the pump discharges fluid into the fuel tank while moving toward the retracted position and takes fluid from the metering chamber while moving toward the extended position.

17. The recoil starter system of claim 14 wherein the pump is actuated by rotation of the pulley prior to the crankshaft being caused to rotate by the spring.

18. The recoil starter system of claim 14 which also comprises at least two springs operably coupling the pulley to the crankshaft with the spring storing energy as the pulley rotates in the unwinding direction prior to the springs causing the crankshaft to rotate.

19. The recoil starter system of claim 1 wherein the carburetor includes a fuel and air mixing passage through which a fuel and air mixture is delivered to the engine, a fuel metering chamber from which fuel is delivered into the fuel and air mixing passage, and an inlet valve that controls the admission of fuel to the fuel metering chamber, and when the pump is actuated the pump draws fluid out of the fuel metering chamber but does not cause liquid fuel to enter the fuel metering chamber through the inlet valve such that actuation of the pump does not cause liquid fuel to enter the fuel and air mixing passage to avoid flooding the carburetor or engine.

* * * * *

UNITED STATES PATENT AND TRADEMARK OFFICE

CERTIFICATE OF CORRECTION

PATENT NO. : 7,600,505 B2
APPLICATION NO. : 11/092532
DATED : October 13, 2009
INVENTOR(S) : George M. Pattullo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 726 days.

Signed and Sealed this

Fifth Day of October, 2010

David J. Kappos

David J. Kappos
*Director of the United States Patent and Trademark Office*